United States Patent [19]

Miles et al.

[11] Patent Number: 4,929,955

[45] Date of Patent: May 29, 1990

[54] CIRCULAR WAVEGUIDE AMPLITUDE COMMUTATOR

[75] Inventors: Thomas O. Miles, Madeira Beach; Carl E. Kreitzer, St. Petersburg, both of Fla.

[73] Assignee: E-Systems, Inc., Dallas, Tex.

[21] Appl. No.: 165,002

[22] Filed: Mar. 7, 1988

[51] Int. Cl.[5] ..... H01Q 3/26; H01P 5/12

[52] U.S. Cl. ..... 342/371; 342/434; 343/777; 333/137

[58] Field of Search ..... 333/137, 125, 117; 343/777, 778; 342/771–773, 427, 433, 434

[56] References Cited

U.S. PATENT DOCUMENTS

| | | | |
|---|---|---|---|
| 3,290,682 | 12/1966 | Ajioka | 333/137 X |
| 3,728,648 | 4/1973 | Lerner | 333/21 R X |
| 4,005,379 | 1/1977 | Lerner | 333/21 R X |
| 4,091,334 | 5/1978 | Sechi | 330/286 X |
| 4,103,262 | 7/1978 | Woodward | 333/136 |
| 4,158,183 | 6/1979 | Wong et al. | 333/21 A |
| 4,367,446 | 1/1983 | Hall | 333/135 |
| 4,446,463 | 5/1984 | Irzinski | 342/371 |
| 4,566,012 | 1/1986 | Choung et al. | 342/354 |

OTHER PUBLICATIONS

IEEE, Transactions on Microwave Theory and Techniques, vol. MTT-29, No. 3, Mar. 1981.

*Primary Examiner*—Eugene R. Laroche
*Assistant Examiner*—Benny T. Lee
*Attorney, Agent, or Firm*—Harold E. Meier

[57] ABSTRACT

A circular waveguide section which is suitably excited with a $TM_{01}$ and two spatially orthogonal $TE_{11}$ modes to form a cosine-squared-on-a pedestal amplitude distribution at the outputs of the circular waveguide. The resulting cosine-squared-on-a-pedestal amplitude taper may be distributed to the elements of a circular phased array to form a low sidelobe antenna. Since the waveguide is a reciprocal element, it can be used in a receiver as well as a transmitter.

9 Claims, 3 Drawing Sheets

CIRCULAR WAVEGUIDE AMPLITUDE COMMUTATOR

TECHNICAL FIELD

The present invention relates generally to microwave (R.F.) amplitude commutation devices and in particular to amplitude commutation devices which are implemented in a circular waveguide.

BACKGROUND OF THE INVENTION

An important area in the design of phased arrays is the R.F. distribution network. This distribution network must divide and/or combine an incoming signal and appropriately weight each component when sidelobe level control is required. In designing a circular or cylindrical phased array, the R.F. distribution network generally falls into one of three categories: (1) Lens feeds, (2) matrix feeds, and (3) amplitude commutator networks. Based on electrical, mechanical and design flexibility considerations, the preferred choice is usually an amplitude commutation network. Amplitude commutation networks are especially important when arrays consisting of a large number of elements are required.

The design of an amplitude commutation network can be aggravated when a system is required to operate at very high microwave frequencies and/or very high power levels. These complexities are a direct result of the small dimensions required at higher frequencies and the power limitations that small dimensions impose on the design.

For example, U.S. Pat. Nos. 3,728,648 and 4,005,379 both relate to commutating a cosine-squared-on-a-pedestal amplitude taper to excite a low sidelobe circular array with a radial and a coaxial waveguide. In U.S. Pat. No. 4,446,463, a multiplexer is used for system improvement while using a coaxial waveguide. The multiplexer allows all of the modes to be excited with only four input probes and the coaxial waveguide implementation increased the operating bandwidth over that obtainable with a radial waveguide. Again, however, because of the constraints imposed upon the design by the dimensions of the inner and outer conductors in the coaxial waveguide, the frequency at which the device operates and the amount of power that can be applied is limited. Thus, it is desirous to have an amplitude commutation network which can operate at high frequencies and high power levels.

The present invention provides an improved amplitude commutation network by utilizing a circular waveguide amplitude commutator. Since there is no inner conductor in the circular waveguide, for any given dimension of the circular waveguide as compared to the coaxial waveguide, a higher frequency can be utilized and higher power levels can be applied to the waveguide.

The circular waveguide section is suitably excited at its input with a $TM_{01}$ mode and two spatially orthogonal $TE_{11}$ modes to form a cosine-squared-on-a-pedestal amplitude distribtuion at the outputs of the circular waveguide. The resulting cosine-squared-on-a-pedestal amplitude taper may be distributed to the elements of a circular (or cylindrical) phased array to form a low sidelobe antenna.

In the preferred embodiment, a circular waveguide is configured with N output ports where N corresponds to the number of illuminated elements on a circular (or cylindrical) phased array. The $TM_{01}$ mode and the spatially orthogonal $TE_{11}$ modes are multiplexed onto four input probes. It is to be understood however that the input probes may be individually excited by these modes. At the ouput probes, an electric field will exist by a superposition of the $TM_{01}$ and the orthogonal $TE_{11}$ mode signals. In one embodiment, the output probes are excited from quadrant to quadrant by a reversal of the polarity of one or both of the orthogonal $TE_{11}$ mode signals at the input ports.

Thus, the present invention relates to a microwave amplitude commutator for forming a cosine-squared-on-a-pedestal amplitude distribution at the output of a circular waveguide.

The present invention provides a microwave amplitude commutation device having a circular waveguide with four input ports which are excited with $TM_{01}$ and $TE_{11}$ signals and having the amplitude distribution of the signals commutated to N output ports on the circular waveguide by varying the relative amplitude and polarities of orthogonal $TE_{11}$ input signals.

The invention couples the orthogonal $TM_{11}$ mode signals to the input ports of a circular waveguide and couples the resulting cosine-squared-on-a-pedestal output signal to the output ports with commutation of the output signal from quadrant to quadrant occurring by reversing the polarity of one or both of the $TE_{11}$ mode signals applied to the input ports.

SUMMARY OF THE INVENTION

Thus, in accordance with the present invention, a microwave signal amplitude commutation device for forming a cosine-squared-on-a-pedestal amplitude taper distribution signal at the output of a waveguide comprises a circular waveguide section having four quadrature input ports at one end, N output ports at the other end and both ends short circuited, means for exciting the input ports with microwave signals of the $TM_{01}$ mode and spatially orthogonal $TE_{11}$ mode, and means for commutating the resulting signal distribution to excite the output ports in selected quadrants of the circular waveguide.

Also in accordance with the invention, a method of commutating a cosine-squared-on-a-pedestal amplitude distribution microwave signal at the output of a waveguide comprises the steps of forming four quadrature input ports at one end of a circular waveguide and N output ports at the other end, short circuiting both ends of the circular waveguide, exciting the input ports with microwave signals of the $TM_{01}$ mode and the spatially orthogonal $TE_{11}$ mode, and commutating the resulting signal distribution to excite the output ports in selected quadrants of the circular waveguide.

BRIEF DESCRIPTION OF THE DRAWINGS

For a more complete understanding of the present invention and the advantages thereof, reference is now made to the following description taken in conjunction with the accompanying drawings.

Referring to the drawings.

DETAILED DESCRIPTION OF THE DRAWINGS

Figure 1:
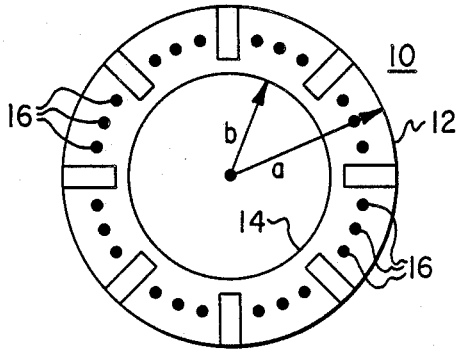
FIG. 1 is a cross-sectional view of a coaxial waveguide having twenty-four output ports and showing the inner and outer dimension of an exemplary waveguide.

FIG. 1 is a cross-sectional representation of a coaxial waveguide generally designated by the numeral 10 illustrating the outer conducter 12 and the inner conducter 14 with twenty-four output probes 16 circumferentially positioned between the outer and inner conductors 12 and 14. With a design frequency of 5 GHz and utilizing 50 ohm probes 16 associated with the output ports (see FIG. 3 and FIG. 5), the outer diameter A equals 1 inch and the inner diameter B is 0.966 inches. Thus the difference between the outer and inner diameters is 0.034 inches. As the frequency of the device increases, the dimensions become even smaller and these smaller dimensions not only impose design problems, but also place power limitations upon the operation of the device.

Figure 2:
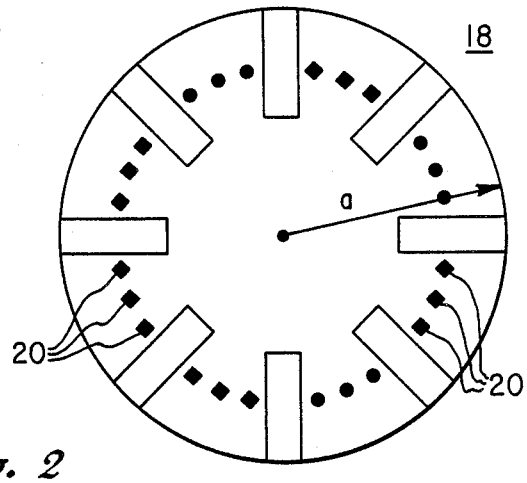
FIG. 2 is a cross-sectional view of a circular waveguide also having twenty-four outport ports and showing the corresponding outer dimension as compared with the inner and outer dimension of the coaxial waveguide.

FIG. 2 represents a cross-sectional view of a circular waveguide 18 having twenty-four output probes 20 circumferentially located about the space on the interior thereof. For the same radius "a" of 1 inch as in FIG. 1, the interior spacing is increased and the device is capable of being utilized at higher frequencies and power levels.

Figure 3:
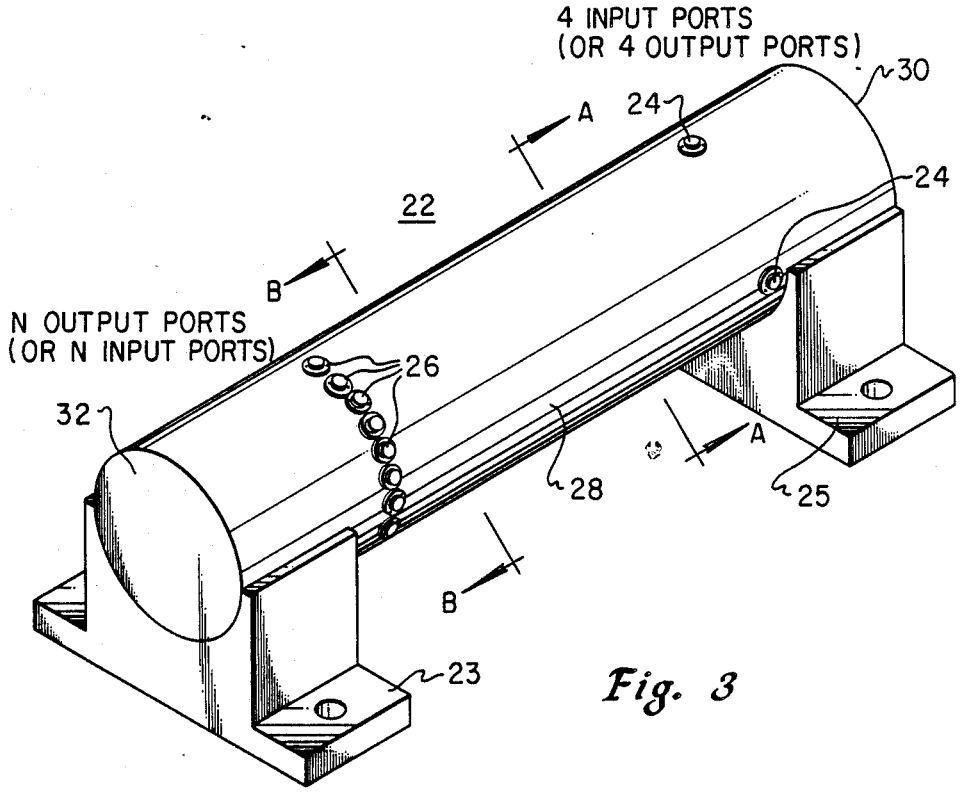
FIG. 3 is an isometric view of the circular waveguide amplitude commutator of the present invention.

FIG. 3 is a diagramatic representation of a circular waveguide 22 with four input ports 24 and N output ports 26 on a cylindrical tube 28. The tube 28 is mounted in support blocks 23 and 25 which may serve a dual role as heat sinks. Each end of the tube 28 is enclosed with end caps 30 and 32 to form a short circuit.

The radius of the tube 28 is selected such that both the $TM_{01}$ and $TE_{11}$ modes are allowed to propagate in the waveguide 10. The device may be operated at even higher frequencies (where the $TE_{21}$ mode could potentially propagate) as long as the four input probes 24 are well-balanced amplitude wise.

The $TM_{01}$ and/or orthogonal $TE_{11}$ modes in waveguide 10 are superimposed at the N outputs 26 to create a cosine-squared-on-a-pedestal amplitude taper distribution. The resulting amplitude distribution is controlled by varying the relative amplitude of the orthogonal $TE_{11}$ modes (note in FIG. 9 that one $TE_{11}$ mode has a cosine dependence and the other a sine dependence). The resulting distribution is commutated from quadrant to quadrant by reversing the polarity of either or both of the $TE_{11}$ modes with appropriate TEM input signals to the waveguide as will be discussed in detail hereafter.

The distance between one of the short circuited end caps 30 and 32 and the corresponding probes in input ports 24 and output ports 26 is adjusted as necessary for impedance matching purposes. Additionally, probe length and diameter are varied for impedance matching.

Figure 4:
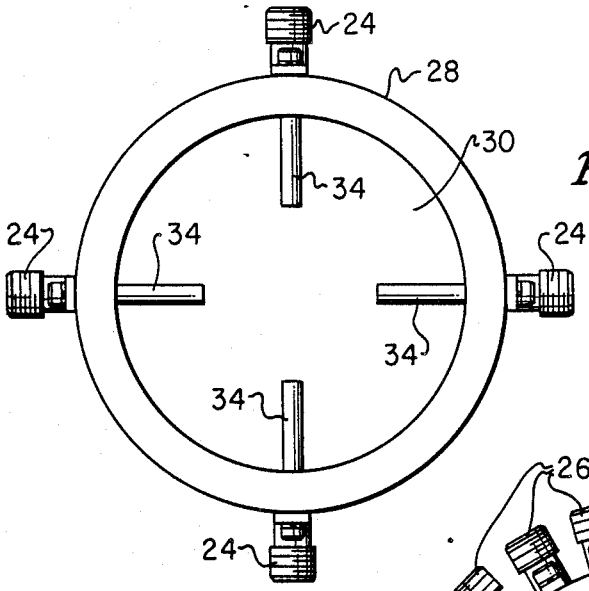
FIG. 4 is a cross-sectional view of the input end of the amplitude commutator of FIG. 3.

A cross-sectional view of the input port end of the commutator in FIG. 3 taken along lines A-A is illustrated in FIG. 4. Each of the input ports 24 in tube 28 is attached to a probe 34 extending on the interior of tube 28. As indicated earlier, these probes are adjusted to a specific distance from the short circuit end cap 30 for impedance matching purposes. In addition, the length of the probes 34 and the diameter thereof are varied for impedance matching as is well known in the art.

Figure 5:
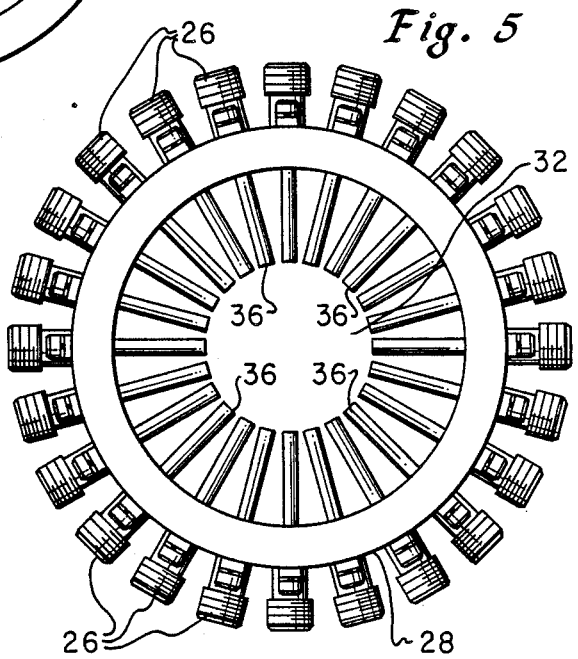
FIG. 5 is a cross-sectional view of the output end of the circular waveguide amplitude commutator of FIG. 3.

FIG. 5 is a cross-sectional view of the commutator of the present invention taken along lines B-B of FIG. 3 and illustrate the position of output ports 26 attached to the tube 28. Again, each of the output ports 26 has a probe 36 associated therewith on the interior of the tube 28 in a spaced relationship from short circuit end cap 32. The distance betweent the probes 36 and the short circuit end wall 32 is adjusted for impedance matching purposes. Also, as discussed previously, the length of each probe 32 and the diameter thereof is varied for impedance matching.

Figure 6:
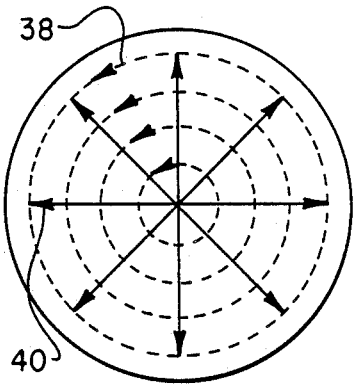
FIG. 6 is a representation of the circular waveguide mode for $TM_{01}$ showing the E and H fields.
Figure 7:
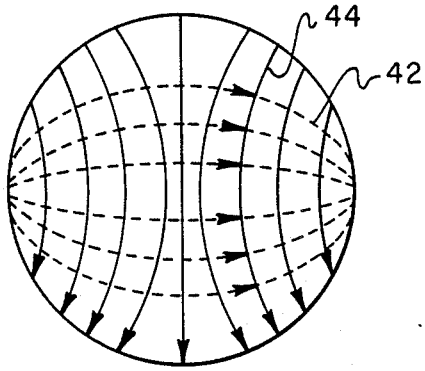
FIG. 7 is a representation of a $TE_{11}$ circular waveguide mode showing the E and H fields.
Figure 8:
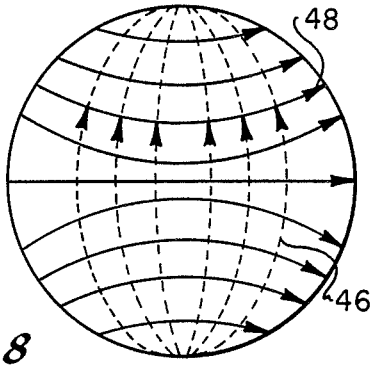
FIG. 8 is a representation of the orthogonal $TE_{11}$ circular waveguide mode showing the E and H fields.

FIG. 6 is a schematic representation of the $TM_{01}$ mode in the circular waveguide and illustrates the H field (magnetic) 38 and E field (electric) 40. In like manner, FIG. 7 is a schematic representation of the $TE_{11}$ circular waveguide mode and again illustrates the H field 42 and E field 44. FIG. 8 illustrates the orthogonal $TE_{11}$ circular waveguide mode illustrating the H field 46 and E field 48.

Figure 9:
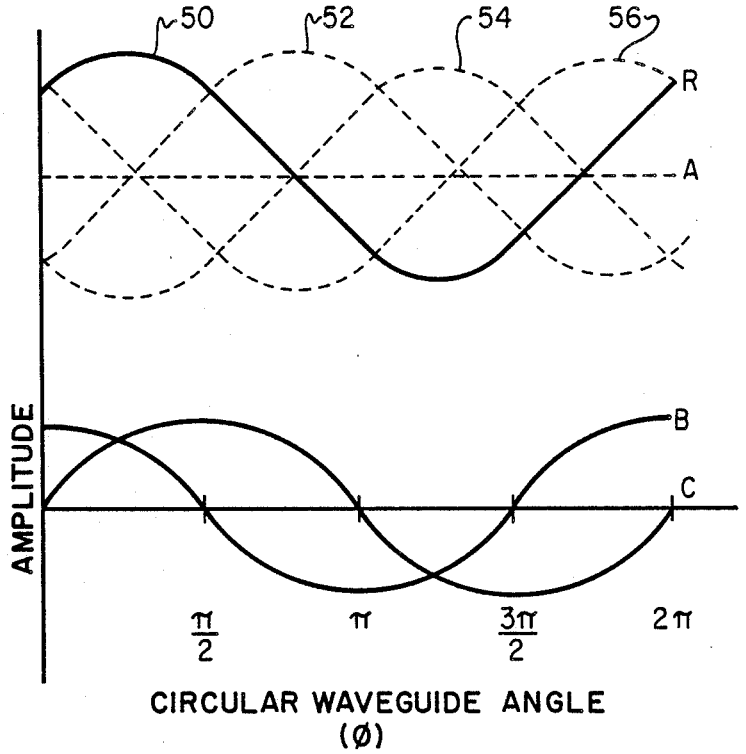
FIG. 9 is a graph of the wave forms for the $TM_{01}$ mode, the $TE_{11}$ mode, the orthogonal $TE_{11}$ mode and the resultant output of the amplitude commutator.

FIG. 9 illustrates the amplitude of the $TM_{01}$ mode wave about the circumference of the circular waveguide to be a constant value designated by the dashed-line A. The cosine wave B represents the $TE_{11}$ mode and sine wave C represents the orthogonal $TE_{11}$ mode in the waveguide. Note that waveform 50 which is superimposed on the $TM_{01}$ mode level A (the pedestal), is the resultant R of the combined orthogonal $TE_{11}$ modes illustrated by waves B and C. Thus the maximum amplitude of resultant waveform 50 occurs in the first quadrant between 0 degrees and 90 degrees.

If the polarity of only the cosine wave B is reversed and then added to the orthogonal $TE_{11}$ mode, the resultant waveform 52 is obtained which is a maximum in the second quadrant or the quadrant between 90 degrees and 180 degrees. If the polarity of both the cosine wave B, the $TE_{11}$ mode, and the sine wave C, the orthogonal $TE_{11}$ mode, are reversed, waveform 54 is obtained as the resultant when waveforms B and C are added thus producing a maximum in the third quadrant between 90 degrees and 270 degrees. Finally, if the polarity of only the sine wave C, the orthogonal $TE_{11}$ mode, is reversed, the resultant waveform is waveform 56 which reaches a maximum in the fourth quadrant between 270 degrees and 0 degrees. Thus, as pointed out previously, the resulting amplitude distribution may be commutated by varying the relative amplitudes of the orthogonal $TE_{11}$ modes and is commutated from quadrant to quadrant by reversing the polarity of one or both $TE_{11}$ modes.

Figure 10:
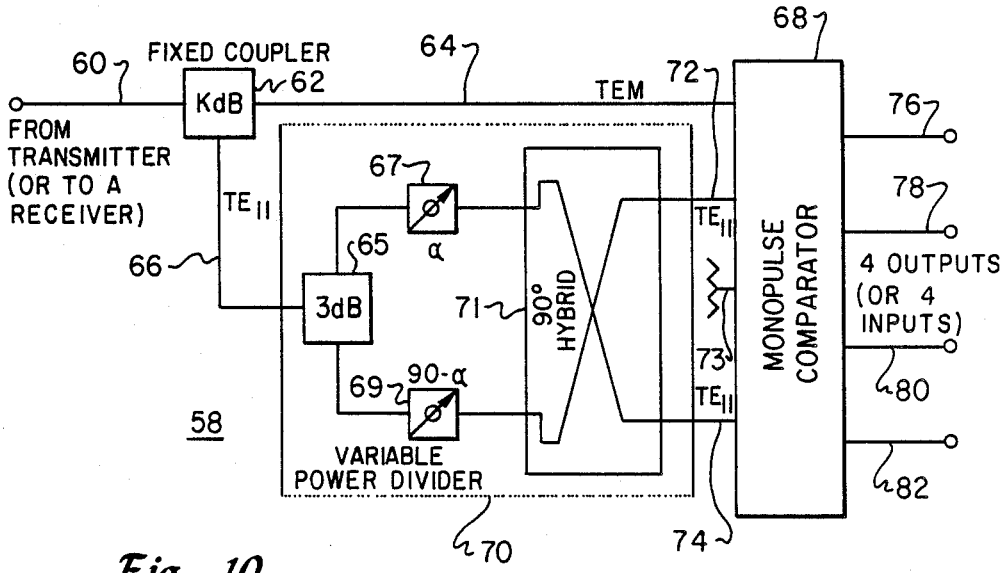
FIG. 10 is a schematic representation of the multiplexer feed network for coupling the input signals to the quadrature input ports of the novel amplitude commutator.

FIG. 10 is a diagrammatic representation of a multiplexer feed network 58 as described in U.S. Pat. No. 4,446,463 to generate the TEM and $TE_{11}$ signals which are applied to the four input ports of the circular waveguide. Thus the signals from the transmitter on line 60 pass through fixed coupler 62 to both lines 64 and 66. The TEM signal on line 64 is coupled directly to the sum input of a monopulse comparator 68 to excite the $TM_{01}$ mode in the circular waveguide. The $TE_{11}$ output on line 66 is coupled to a variable power divider network 70 which includes a 3 dB tee 65, a pair of differential phase shifters 67 and 69 for controlling the relative magnitudes and phases of the R.F. outputs, and a 90° hybrid 71 for exciting a pair of spatially orthogonal $TE_{11}$ modes in the circular waveguide 22 with the signals on lines 72 and 74 and which are spaced 90 degrees apart as shown in FIG. 9. These $TE_{11}$ outputs on lines 72 and 74 are coupled to the monopulse comparator 68 which operates in a well known manner to produce a combination of output signals on lines 76, 78, 80 and 82. These signals are coupled as input signals to the four input ports 24 on the circular waveguide 22 illustrated in FIG. 3. Thus, the TEM input signal on line 64 is coupled to a sum port of comparator 68. This sum input excites the $TM_{01}$ mode in the circular waveguide 22 through the four input ports 24. The $TE_{11}$ output signals on lines 72 and 74 from power divider 70 are coupled as inputs to the difference ports of comparator 68. Input line 73 to comparator 68 is suitably terminated and the $TE_{11}$ outputs of comparator 68 to input ports 24 also cause waveguide 22 to be excited with a pair of spatially orthogonal $TE_{11}$ mode signals. An electric field will exist in waveguide 22 by a superposition of the $TM_{01}$ and orthogonal $TE_{11}$ mode pairs. Simply by changing the phase of the $TE_{11}$ signals with phase shifters 67 and 69, the waveguide output signals will be commutated in the various quadrants as shown in FIG. 9. Thus multiplexer 58 allows all of the modes to be excited in the waveguide with only the four input ports 24 in FIG. 3.

While the invention has been disclosed for use in a transmitter, it is to be understood that the waveguide is a reciprocal element and it will function equally well in a receiver system. In that case, the N output ports coupled to the antenna array become the input ports. The four input ports in FIG. 3 become the output ports coupled to the multiplexer 58 in FIG. 10 which is a bidirectional device. The output of coupler 62 on line 60 is coupled to the receiver.

Thus there has been disclosed a novel circular waveguide amplitude commutator which is suitably excited at its input with a $TM_{01}$ and two spatially orthogonal $TE_{11}$ modes to form a cosine-squared-on-a-pedestal amplitude taper distribution at the outputs of the circular waveguide to form a low sidelobe antenna system. The resulting distribution may be commutated from quadrant to quadrant in the output of the waveguide by reversing the polarity of one or both $TE_{11}$ modes.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined in the appended claims.

We claim:

1. A microwave signal amplitude commutation device generating a cosine-squared-on-a-pedestal signal amplitude distribution at the output ports of a waveguide to be distributed to N elements of a circular or cylindrical phased array to form a low sidelobe antenna comprising:

a circular waveguide section having four quadrature ports at one end, N ports at the other end and both ends short circuited, means coupled to the four quadrature ports for exciting the waveguide with microwave signals in a $TM_{01}$ mode and in spatially orthogonal $TE_{11}$ modes to generate a resulting signal amplitude distribution at the quadrature ports, and means coupled to the exciting means for commutating the resulting signal distribution to excite the N ports in selected quadrants of the circular waveguide.

2. A device as in claim 1 wherein said commutating means further comprises means for varying the polarities of said microwave signals coupled to said quadrature ports to commutate the resulting signal amplitude distribution at the quadrature ports to predetermined ones of the N ports.

3. A device as in claim 2 wherein the commutating means commutates the signals to the N ports in selected quadrants by reversing the polarity of selected ones of the orthogonal mode microwave signals applied to the quadrature ports.

4. A device as in claim 2 wherein said signal commutating means is a multiplexer coupled to the quadrature ports.

5. A method of commutating a cosine-squared-on-a-pedestal microwave signal amplitude distribution at the output ports of a waveguide to be distributed to the elements of a circular or cylindrical phased array to form a low sidelobe antenna comprising the steps of:

forming four quadrature ports at one end of a circular waveguide and N ports at the other end, short circuiting both ends of the circular waveguide, coupling microwave signals to the quadrature ports for exciting within the waveguide a $TM_{01}$ mode signal and spatially orthogonal $TE_{11}$ mode signals to generate a resulting signal amplitude distribution at the quadrature ports and commutating the resulting signal distribution to excite the N ports in selected quadrants of the circular waveguide.

6. A method as in claim 5 wherein the step of commutating the resulting signal distribution further comprises the step of varying the relative polarities of the orthogonal mode microwave signals at the quadrature ports to commutate the resulting signal amplitude distribution at the quadrature ports to predetermined ones of the N ports.

7. A method as in claim 6 wherein the step of commutating the amplitude distribution to predetermined ones of the N ports in selected quadrants further comprises the step of reversing the polarity of selected ones of the orthogonal mode microwave signals applied to the quadrature ports.

8. A method as in claim 6 wherein the step of commutating the signal amplitude at the quadrature ports further comprises the step of coupling a multiplexer to the quadrature ports for commutating the microwave signals.

9. A microwave signal amplitude commutator for an R.F. receiver, said commutator receiving at N ports a cosine-squared-on-a-pedestal amplitude distribution signal from N elements of a circular or cylindrical phased antenna forming a low sidelobe antenna array, said commutator comprising:

a circular waveguide section having N ports at one end for receiving said signal from the N corresponding elements of the antenna array for exciting a $TM_{01}$ mode signal and spatially orthogonal $TE_{11}$ mode signals in selected quadrants of the waveguide, four quadrature ports at the other end and both ends short circuited, means coupled to said quadrature ports for commutating a signal amplitude distribution comprising of the $TM_{01}$ mode signal and spatially orthogonal $TE_{11}$ mode signals in the waveguide, means coupled to the commutating means for recovering the $TM_{01}$ mode signal and the spatially orthogonal $TE_{11}$ mode signals at the four quadrature ports, means coupled to the signal recovering means for separating the signals at the quadrature ports into TEM and spatially orthogonal $TE_{11}$ signals, and means coupled to the separating means for receiving the separated TEM and spatially orthogonal $TE_{11}$ signals and generating a composite TEM signal for transfer to the receiver.

* * * * *